US006007077A

United States Patent [19]

Moe

[11] Patent Number: 6,007,077

[45] Date of Patent: Dec. 28, 1999

[54] STEP-IN SNOWBOARD BINDING

[76] Inventor: Christopher R Moe, 1724 W. Avis, Spokane, Wash. 99208

[21] Appl. No.: 09/131,308

[22] Filed: Aug. 7, 1998

Related U.S. Application Data

[63] Continuation of application No. 08/980,809, Dec. 1, 1997, abandoned.

[51] Int. Cl.[6] ..... B62B 9/04

[52] U.S. Cl. ..... 280/14.2; 280/620; 280/607

[58] Field of Search ..... 280/617, 618, 280/607, 619, 611, 623, 625, 634, 14.2, 616, 622, 620, 636

[56] References Cited

U.S. PATENT DOCUMENTS

| | | | |
|---|---|---|---|
| 2,246,153 | 6/1941 | Wallace | 280/11.35 |
| 2,686,059 | 8/1954 | Whitaker | 280/11.35 |
| 2,758,846 | 8/1956 | Swansen | 280/11.35 |
| 2,764,418 | 9/1956 | Shimizu | 280/11.35 |
| 3,877,712 | 4/1975 | Weckeiser | 280/11.35 |
| 3,908,971 | 9/1975 | Engel | 280/11.35 |
| 3,944,237 | 3/1976 | Teague, Jr. | 280/623 |
| 4,152,009 | 5/1979 | Schmid | 280/614 |
| 4,237,628 | 12/1980 | Etancelin | 36/131 |
| 4,322,090 | 3/1982 | Loughney | 280/614 |
| 4,836,572 | 6/1989 | Pozzobon | 280/613 |
| 5,234,230 | 8/1993 | Crane | 280/811 |
| 5,360,229 | 11/1994 | Arduin et al. | 280/617 |
| 5,397,149 | 3/1995 | Couderc et al. | 280/602 |
| 5,459,947 | 10/1995 | Lasher | 36/54 |
| 5,609,347 | 3/1997 | Dressel | 280/14.2 |
| 5,638,614 | 6/1997 | Hardy | 36/113 |
| 5,642,897 | 7/1997 | Couderc et al. | 280/607 |
| 5,647,148 | 7/1997 | Meiselman | 280/14.2 |
| 5,647,605 | 7/1997 | Arduin | 280/607 |
| 5,692,765 | 12/1997 | Laughlin | 280/619 |
| 5,727,797 | 3/1998 | Bowley | 280/14.2 |
| 5,826,891 | 10/1998 | Albrecht | 280/14.2 |
| 5,909,886 | 6/1999 | Tugutaka et al. | 280/14.2 |

FOREIGN PATENT DOCUMENTS

| | | | |
|---|---|---|---|
| 492390 | 1/1953 | Canada . | |
| 432539 | 1/1926 | Germany . | |
| 4106401 | 9/1992 | Germany | 280/617 |
| 200703 | 1/1939 | Switzerland . | |

OTHER PUBLICATIONS

"Burton" Snowboards Ad.
"DNR" Interface Snowboards Ad.
"Palmer" Snowboard 1999 Ad.
"Shamano" Snowboard Ad.

*Primary Examiner*—Paul N. Dickson
*Assistant Examiner*—Lynda Jasmin
*Attorney, Agent, or Firm*—David S. Thompson

[57] ABSTRACT

A step-in snowboard binding 100 provides a base assembly 200 which is adjustably attached to the snowboard at an angle that is selected by the user. A front assembly 300 and a back assembly 400 are pivotally carried by the base assembly and are pivotally connected to each other. The front and back assemblies pivot between a closed and locked boot-restraining position, and an open step-in/out position. In a preferred embodiment, the front assembly carries an adjustable toe strap 350 and an adjustable foot strap 360. A fastening assembly 500 releasably locks the front and back assemblies together in the closed boot-restraining position. With both boots locked in the boot restraining position, the user is able to operate the snowboard. The fastening assembly is easily released, allowing the front and back assemblies to pivot to the step-in/out position. In this position, the user is able to step into or out of each binding.

1 Claim, 4 Drawing Sheets

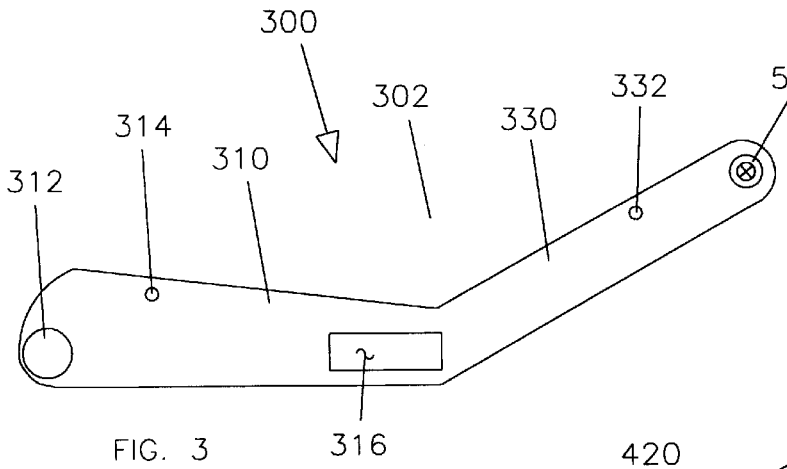
FIG. 3
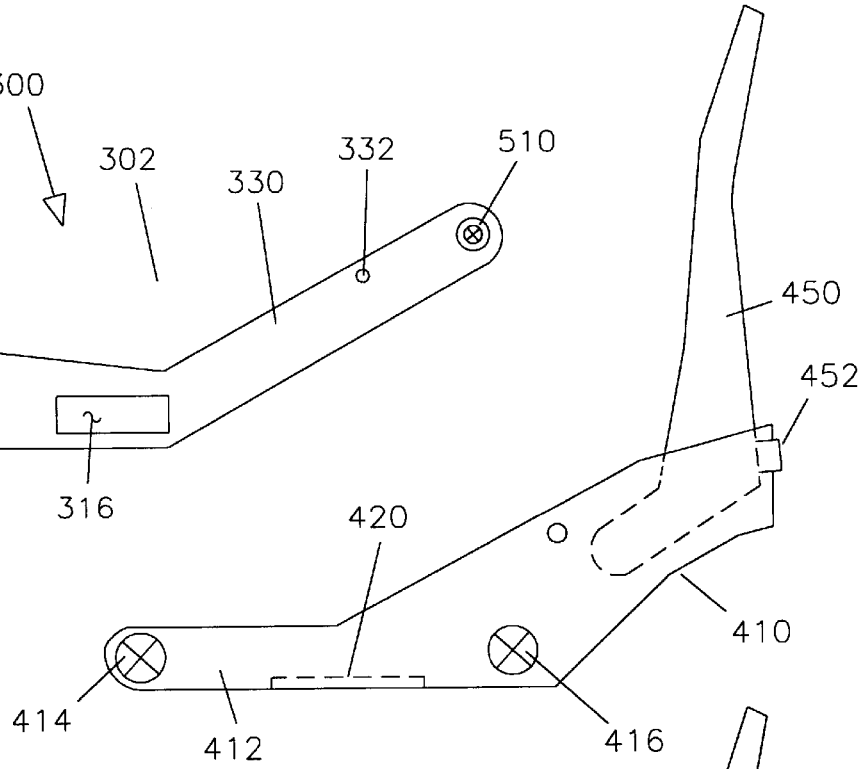
FIG. 4
FIG. 5
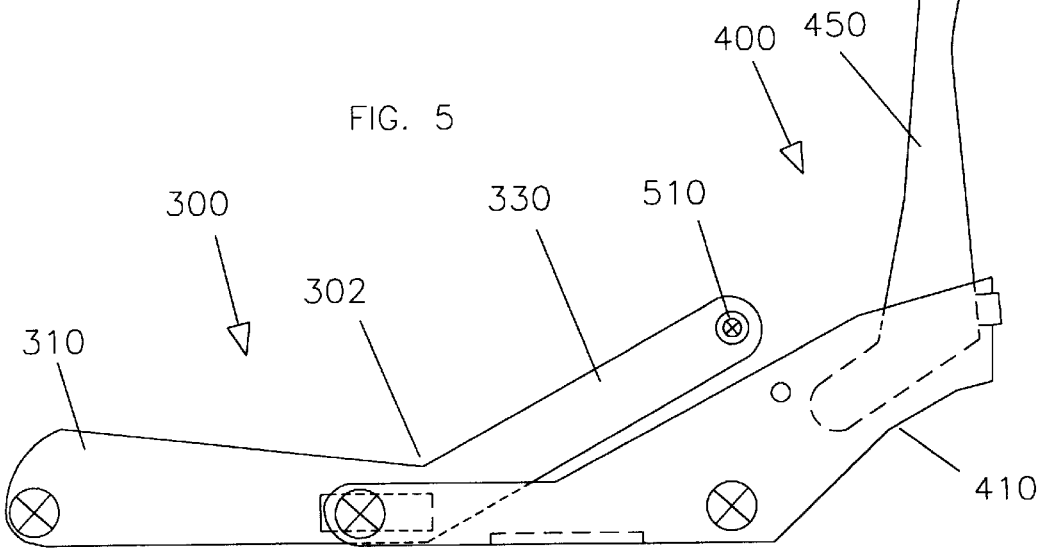

STEP-IN SNOWBOARD BINDING

CROSS-REFERENCES

The present application is a continuation of application Ser. No. 08/980,809 filed Dec. 1, 1997, now abandoned.

BACKGROUND

In the sport of snowboarding, bindings used to attach boots to snowboards include those types directed to the use of hard-sided boots and soft-sided boots. Soft-sided boots, having a flexible sole, have well-recognized advantages in terms of comfort and wearability over other types of boots when not attached to the bindings. However, the bindings used with soft-sided boots having failed to provide the structures required to provide step-in convenience.

Attempts at creating a step-in binding for soft-sided boots have generally resulted in specialized hardware carried by the sole of the boot that is adapted for use with a specific binding. As a result, users must purchase boots and bindings as a set. There are financial problems with this for both snowboarders and for retailers, who must stock an additional inventory of boots. Additionally, it is typically the case that the specialized mounting hardware carried by the boots reduces their usefulness for walking when not attached to the bindings. The hardware tends to clog with snow, and the effectiveness, comfort and convenience of the binding is reduced.

For the foregoing reasons, there is a need for a step-in snowboard binding that is adapted for use with soft-sided boots, and which allows a user to step into the binding, in a rapid and automatic motion, typically without the need to bend over, operate fasteners or make adjustments.

SUMMARY

The present invention is directed to an apparatus that satisfies the above needs. A novel step-in snowboard binding is provided that is adapted for use with soft-sided boots and which allows a user to step into the binding, in a rapid and automatic motion, typically without the need to bend over, operate fasteners or make adjustments.

The step-in snowboard binding of the present invention provides some or all of the following structures.

(A) A base assembly is sized somewhat greater in width, but typically slightly shorter in length, than the boot to be supported, and is attached to the upper surface of the snowboard. The base assembly typically provides a base plate carrying left and right side rails, the side rails defining left and right adjustment holes, respectively.

(B) A front assembly typically carries adjustable toe and foot straps which restrain the boot worn by the user. The front assembly pivots on a forward portion of the base assembly between a lowered boot-restraining position and a raised step-in/out position.

(C) A back assembly typically provides a heel cup which carries a foot plate and an adjustable high-back heal support. The back assembly pivots on a rear portion of the base between a forward boot-restraining position and a leaned-back step-in/out position.

(D) Inter-connection means, connecting the front assembly and the back assembly, causes movement of one assembly, in either direction, between the boot-restraining position and step-in/out position, to cause movement of the other assembly to the same position. For example, upward pressure on the toe and foot straps of the front assembly raises the front assembly and therefore causes the back assembly to move into the opened step-in/out position. Similarly, pressure on the heel plate pivots the back assembly forward and therefore causes the front assembly to lower into the boot-restraining position.

(E) A fastening assembly, having elements carried by the front and back assemblies, for locking the front and back assemblies into a boot-restraining position. It is in this position that the binding is used. The fastening assembly is unlockable, thereby allowing the front and back assemblies to move into the step-in/out position. It is a significant advantage of the step-in binding of the invention that moving the front and back assemblies fully into the boot-restraining position results in the fastening assembly locking.

It is therefore a primary advantage of the present invention to provide a novel step-in snowboard binding that allows rapid and convenient attachment of any soft-sided boot, to a snowboard, and which does not require a boot having specific mounting hardware compatible to a specific binding.

Another advantage of the present invention is to provide a novel step-in snowboard binding that is fully adjustable, and that does not require that the user bend over to connect any fasteners.

Another advantage of the present invention is to provide a novel step-in snowboard binding that allows the foot strap and toe strap to be arranged in a wide variety of configurations not possible with conventional bindings because of their need for foot strap and toe strap flexibility.

A still further advantage of the present invention is to provide a novel step-in snowboard binding that opens widely to allow boot movement when in the step-in/out position, and which closes on the boot without the need for adjustment or bending over, when locked into the boot-restraining position.

DRAWINGS

These and other features, aspects, and advantages of the present invention will become better understood with regard to the following description, appended claims, and accompanying drawings where:

FIG. 3 is a side orthographic view of a front element of the front assembly.

FIG. 4 is a side orthographic view of the back assembly.

FIG. 5 is a side orthographic view of the front assembly and back assembly in the closed, boot-restraining position, with other assemblies removed for clarity.

DESCRIPTION

Figure 1:
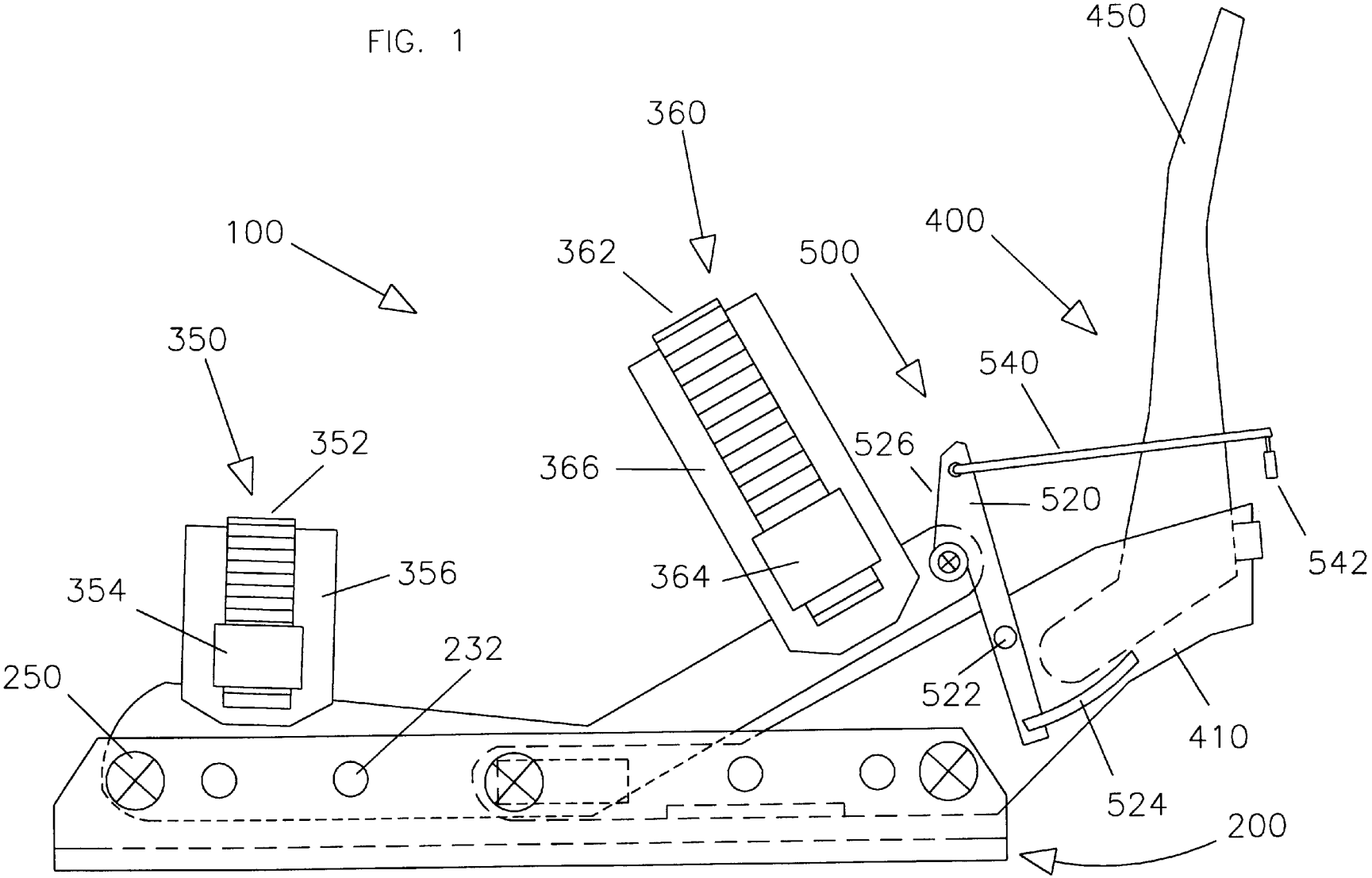
FIG. 1 is a side orthographic view of a version of the step-in snowboard binding of the invention, locked into the boot-restraining position.

Referring in generally to FIGS. 1 through 8, a step-in snowboard binding 100 constructed in accordance with the principles of the invention is seen. The step-in binding provides a base assembly 200 which is adjustably attached to the snowboard at an angle that is selected by the user. A front assembly 300 and a back assembly 400 are pivotally carried by the base assembly and are pivotally connected to each other. The front and back assemblies pivot between a closed and locked boot-restraining position, and an open step-in/out position. In a preferred embodiment, the front assembly carries an adjustable toe strap 350 and an adjustable foot strap 360. A fastening assembly 500 releasably locks the front and back assemblies together in the closed boot-restraining position. With both boots locked in the boot restraining position, the user is able to operate the snowboard. The fastening assembly is easily released, allowing the front and back assemblies to pivot to the step-in/out position. In this position, the user is able to step into or out of each binding.

Referring to FIGS. 1, 2, 7 and 8 of the drawings, the base assembly 200 is seen. The base assembly provides a base plate 210 carrying opposed left and right side rails 230. In a preferred embodiment, the base plate defines an adjustable board attachment hole 212, which allows the base assembly to be attached to a snowboard at any desired angle, in a conventional manner. An established method of attachment includes a disk having a perimeter defining teeth which mate to corresponding teeth defined in the perimeter of the attachment hole 212. The base plate has a front end (toe end) 214 and a back end (heel end) 216. The width of the base plate is somewhat greater than the width of the boot to be supported; the length of the base plate is typically somewhat shorter than the length of the boot.

The left and right side rails 230 tend to keep the boot from moving laterally, and are spaced apart incrementally greater than the boot to be supported. Each side rail defines a number of spaced adjustment holes 232 which allow the front and rear assemblies to be located as desired. A front pivot 250 carries the front assembly 300 in a pivotal manner. Similarly, the rear pivot 260 carries the back assembly 400 in a pivotal manner.

Referring particularly to FIGS. 1, 2, 3, 5, 6 and 7 of the drawings, the front assembly 300 is seen. In a preferred embodiment, the front assembly 300 provides left and right front elements 302, each having a monolithic structure providing a forward segment 310 and a rear segment 330. The left and right forward segments each define a front pivot hole 312 which is carried by the front pivot 250 of the base. The front pivot 250 and pivot hole 312 allow the front assembly to pivot with respect to the base assembly 200 between a bootrestraining position, seen in FIGS. 1 and 5, and a step-in/out position, seen in FIGS. 2 and 6.

The front segment also carries a toe strap fastener, such as hole 314 or other fastening means, which allows attachment of the toe strap 350.

As seen particularly in FIG. 3, the rear segment 330 is oriented at an angle with respect to the front segment 310. The rear segment carries a foot strap fastener, such as hole 332 or other fastening means, which allows attachment of the foot strap 360.

Figure 2:
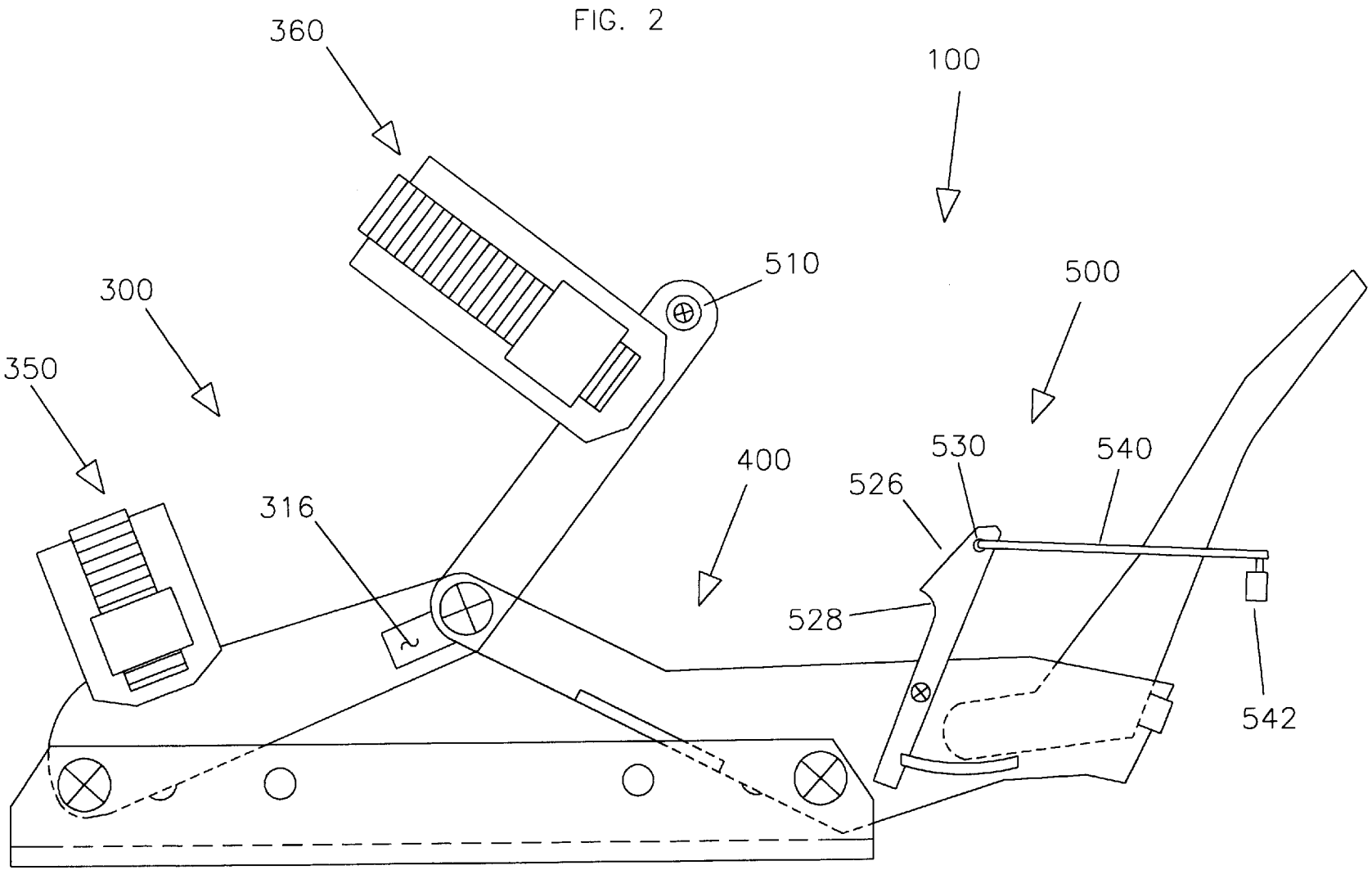
FIG. 2 is a side orthographic view of the snowboard binding of FIG. 1, in the step-in/out position.

Referring to FIGS. 1 and 2, the toe strap 350 and foot strap 360 carried by the front assembly 300 can be seen. The toe and foot straps provide an adjustable fastening means for restraining a boot carried within the binding. The toe strap wraps above and restrains the toe area of the foot, while the foot strap wraps above and restrains an upper portion of the foot. The toe and foot straps may be of a variety of known designs, but in a preferred version include a padded body 356, 366, secured in place by a ladder strap 352, 362 and associated ladder strap fasteners 354, 364.

Referring particularly to FIGS. 1, 2, 3, 5, 6 and 7 of the drawings, the back assembly 400 is seen. In a preferred embodiment, the back assembly 400 provides a heel cup carrying opposed left and right forward segments 412. A sliding pivot 414 is carried by a forward portion of each forward segment 412. A rear pivot hole 416 is defined in a rearward portion of each forward segment, adjacent to the left and right sides of the heel cup. The rear pivot hole allows the back assembly to pivot with respect to the rear pivot 260 of the base assembly 200 between a boot-restraining position, seen in FIGS. 1 and 5, and a step-in/out position, seen in FIGS. 2 and 6.

Figure 8:
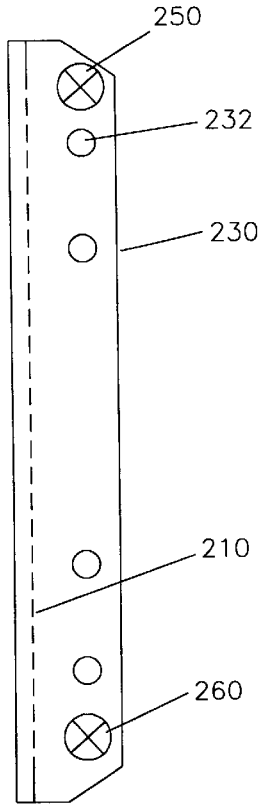
FIG. 8 is a side orthographic view of the base assembly.

As is best seen in FIG. 9, a foot plate 420 is carried between the opposed left and right forward segments 412. The foot plate pivots with the back assembly between a closed boot-restraining position and an open step-in/out position. In the closed, boot-restraining position, as seen in FIGS. 1, 5 and 8, the foot plate 420 is carried flush against, and parallel with, the base plate 210. In the open, step-in/out position, as seen in FIGS. 2 and 6, the foot plate is elevated above, and turned at an angle with respect to, the base plate.

In an alternative embodiment of the invention, the foot plate can be carried between the front elements 302 of the front assembly 300. The structure is typically not preferable, since it tends to congest the toe portion of the binding.

A high-back heel support 450 is carried by the heel cup. In a preferred embodiment, the high-back is positionally adjusted with respect to cup by an adjustment 452, which allows the user to select the angle at which the high-back is oriented. In an alternative embodiment, the high-back could be integrated with the heel cup, resulting in a monolithic structure. This would result in possible cost savings, but would be at the expense of adjustability and performance.

Figure 6:
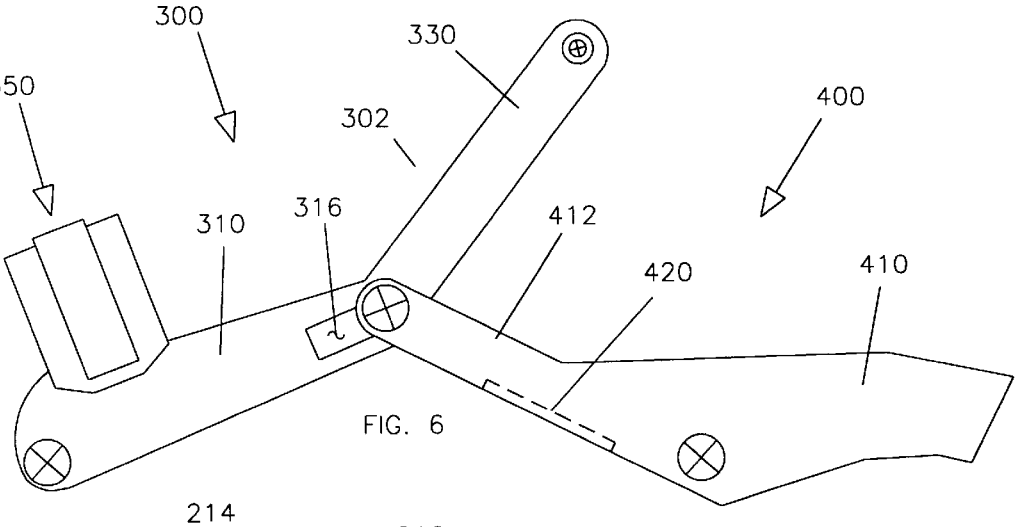
FIG. 6 is a side orthographic view of the front assembly and back assembly in the open, step-in/out position, with other assemblies removed for clarity.
Figure 7:
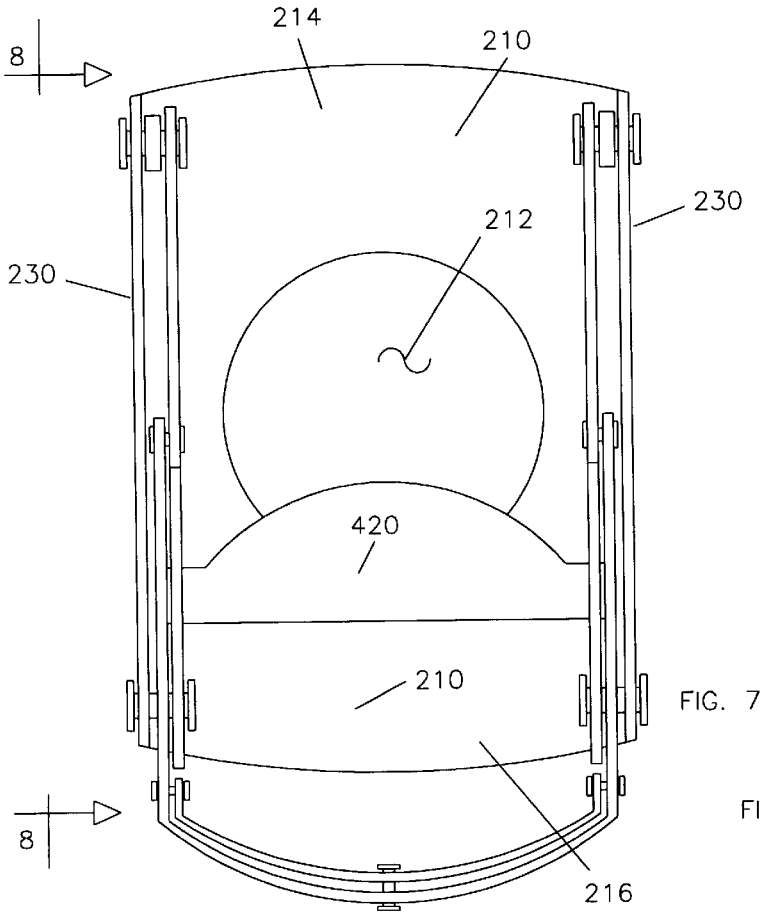
FIG. 7 is a top orthographic view of the binding of FIG. 1.

As seen particularly in FIGS. 3–5, an inter-connection between the front assembly to the back assembly allows the two assemblies to move together between a boot-restraining position, seen in FIGS. 1 and 5, to a step-in/out position, seen in FIGS. 2 and 6. In a preferred embodiment, the interconnection between the front assembly 300 and back assembly 400 includes a slot 316 defined in each of the left and right front elements 302 and sliding pivots 414 carried by each of the left and right forward forward segments of the back assembly. As seen in FIGS. 1 and 5, when the binding is in the closed, boot-restraining position, the left and right sliding pivots 414 are in a forward position within the left and right slots 316. When the binding is opened, the left and right pivots travel to a rearward position within the left and right slots, as seen in FIGS. 2 and 6.

As seen in FIG. 1, a fastening assembly 500 locks the front assembly 300 to the back assembly 400 when the binding is in the boot-restraining position. The fastening assembly may be released, as seen in FIG. 2, allowing the front assembly to pivot forwardly and the rear assembly to pivot rearwardly into the step-in/out position.

While alternative and equivalent fastening assemblies could be substituted, the preferred fastening assembly is seen in FIGS. 1 and 2. As seen in these figures, the fastening assembly includes left and right mirror image locking arms 520, carried by opposed portions of the back assembly 400, and left and right mirror image locking fasteners 510 which may be engaged by the locking arms, and are carried by the front assembly 300.

The locking arms 520 rotate on pivots 522 which are carried by opposed sides of the heel cup 410. Each locking arm is biased into the locked position seen in FIG. 1 by a spring 524 or similar biasing means. A hook 528 defined on each locking arm is sized to engage the locking fastener 510 carried by each rear segment 330 of each front element 302 of the front assembly.

A release mechanism 540 is attached to a release mechanism fastener on the locking arm. A preferred release mechanism may be a wire or cable assembly, as illustrated, but may take other practical forms as desired. In a preferred version of the locking arm 520, the release mechanism is attached to an upper portion of the locking arm at a release mechanism fastener. A preferred version of the version of the release fastener, as illustrated in FIGS. 1 and 2, includes holes 530. A preferred release mechanism includes a handle 542 or other manually operable device which allows the user to urge the release mechanism 540 to overcome the bias of the spring 524 and to thereby disengage the hooks 528 of the locking arms 520 from the locking arm fasteners 510 carried by the front assemblies.

To use the binding 100, the user first unlocks the fastening assembly 500, thereby allowing the binding to open into the step-in/out position seen in FIG. 2. The user then inserts a foot wearing a boot. The boots sole presses on the foot plate 420, causing the rear assembly to close. The inter-connection between the front assembly 300 and the back assembly 400 causes the front assembly to also close. The forward edge 526 of the locking arm 520 advances against the locking fastener 510 until the hook 528 catches, locking against the locking fastener 510, thereby locking the front assembly 300 to the back assembly 400 in the locked position as seen in FIG. 1.

To release the binding and remove the boot, the user pulls on the handle 542 of the release mechanism 540. This causes the hook 528 to release the locking fastener 510 carried by the front assembly 300 as the bias of the spring 524 is overcome. Upward pressure by the boot against the toe strap 350 and foot strap 360 causes the front assembly to open. The inter-connection between the front assembly and back assembly causes the back assembly to open. The binding is then in the unlocked position seen in FIG. 2, allowing the user to remove the boot.

The previously described versions of the present invention have many advantages, including a primary advantage of providing a novel step-in snowboard binding that allows rapid and convenient attachment of any soft-sided boot, to a snowboard, and which does not require a boot having specific mounting hardware compatible to a specific binding.

Another advantage of the present invention is to provide a novel step-in snowboard binding that is fully adjustable, and that does not require that the user bend over to connect any fasteners.

Another advantage of the present invention is to provide a novel step-in snowboard binding that allows the foot strap and toe strap to be arranged in a wide variety of configurations not possible with conventional bindings because of their need for foot strap and toe strap flexibility.

A still further advantage of the present invention is to provide a novel step-in snowboard binding that opens widely to allow boot movement when in the step-in/out position, and which closes on the boot without the need for adjustment or bending over, when locked into the boot-restraining position.

Although the present invention has been described in considerable detail and with reference to certain preferred versions, other versions are possible. For example, while a preferred version of the fastening assembly 500, including a locking arm 520 and associated locking fastener 510 have been disclosed, it is clear that other fastening means could be easily substituted, while still allowing the front and back assemblies 300, 400 to pivot between boot-restraining and a step-in/out positions while the fastening assembly is in the unlocked position. In further example, while in the preferred version disclosed, the slot 316 is defined in the front assembly 300, and the sliding pivot 414 is carried by the back assembly, these elements could easily be reversed, resulting in a equivalent structure. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A binding, for releasably attaching a boot to a snowboard, the binding comprising:

(A) a base assembly;

(B) a front assembly pivotable on a forward portion of the base assembly between a lowered boot-restraining position and a raised step-in/out position;

(C) at least one adjustable strap carried by the front assembly;

(D) a back assembly pivotally carried on a rear portion of the base assembly, the back assembly movable between a boot-restraining position and a step-in/out position, the back assembly comprising:

(a) a heel cup;

(b) an adjustable high-back, carried by the heel cup; and (c) a foot plate, carried by the heel cup;

(E) inter-connection means, connecting the front assembly and the back assembly, for causing the front and rear assemblies to move together; and (F) a fastening assembly, including locking arms pivotally mounted on the back assembly for releasably engaging locking fasteners on the front assembly.

* * * * *